US005439321A

United States Patent [19]

Hunter

[11] Patent Number: 5,439,321

[45] Date of Patent: Aug. 8, 1995

[54] INTERRUPTIVE MOBILE PRODUCTION SYSTEM

[75] Inventor: Andrew F. Hunter, Houston, Tex.

[73] Assignee: Conoco Inc., Ponca City, Okla.

[21] Appl. No.: 29,743

[22] Filed: Mar. 11, 1993

[51] Int. Cl.[6] ..... E02B 17/00

[52] U.S. Cl. ..... 405/195.1; 166/350; 166/359; 405/224

[58] Field of Search ..... 405/195.1, 224, 209, 405/203, 204; 166/350, 359, 367; 175/5, 7

[56] References Cited

U.S. PATENT DOCUMENTS

| | | | |
|---|---|---|---|
| 4,606,673 | 8/1986 | Daniell . | |
| 4,702,321 | 10/1987 | Horton . | |
| 4,913,238 | 4/1990 | Danazcko et al. . | |
| 4,966,495 | 10/1990 | Goldman . | |
| 5,135,327 | 8/1992 | White et al. . | |
| 5,147,148 | 9/1992 | White et al. . | |
| 5,150,987 | 9/1992 | White et al. . | |
| 5,190,411 | 3/1993 | Huete et al. . | |
| 5,207,534 | 5/1993 | Brasted et al. | 405/203 X |

FOREIGN PATENT DOCUMENTS 2250767 12/1991 United Kingdom .

OTHER PUBLICATIONS

Buckman, David; "New concept: Dynamic mooring-positioning system for fixed, compliant modes for platform", Ocean Industry; Mar., 1976; pp. 67–69.

"Turret-moored FPS houses surface wellheads"; Ocean Industry; Apr./May 1991; pp. 75–77.

"Monopod TLP Improves Deepwater Economics"; Petroleum Engineer International; Jan. 1993; pp. 48–51.

*Primary Examiner*—Dennis L. Taylor

*Attorney, Agent, or Firm*—M. Kathryn Tsirigotis

[57] ABSTRACT

The interruptive mobile production (IMP) system comprises a floating semisubmersible structure with equipment and facilities for hydrocarbon production in association with a small tension leg wellhead platform (TLWP) having direct vertical access. The small TLWP has an upper deck positioned above the surface of the water with wellhead equipment thereon and has risers generally vertically connecting subsea wells to the upper deck.

Lateral bending restraints of the risers and tendons are preferably located at about the same horizontal level as the lower pontoon section. The semisubmersible structure can be conveniently disconnected from its moorings and from the wellhead platform for demobilizing to another location while the TLWP remains tethered in place.

25 Claims, 4 Drawing Sheets

INTERRUPTIVE MOBILE PRODUCTION SYSTEM

BACKGROUND OF THE INVENTION

1. Field of the Invention

The present invention relates to floating offshore petroleum, drilling and production systems. More specifically, the present invention combines the advantages of a small tension leg wellhead platform with those of a floating mobile, drilling/production unit for use in deep water.

2. Description of the Background Art

In recent years, there has been a continuing effort to produce crude oil and gas from subterranean formations located in ever increasing water depths. In relatively shallow water, wells maybe drilled in the ocean floor from bottom founded fixed platforms. Because of the large size of the structure needed to support drilling and production facilities in deep water, bottom founded structures are limited to water depths of less than about 1,000 to 1,200 feet. Also, as the water depth exceeds the capacity of divers, accessing the wellheads on the sea floor for servicing and workovers becomes more difficult and more costly resulting in the need for submarines, remotely operated vehicles or the like. In deeper water, floating systems have been used in order to reduce the size, weight, and cost of deep water drilling and production structures.

During the past few years, there have been a number of developments in deep water oil and gas production technology, including the semisubmersible floating production platform. The semisubmersible floating production platform consists of a floatation hull and deck. The floatation hull typically is four or more large diameter vertical columns which extend downwardly from the deck and are supported by two or more horizontal pontoons. Semisubmersible platforms are held in position using catenary mooring lines. Submerging the floatation hull beneath the water surface reduces the effect of environmental forces such as wind and waves and results in a relatively stable work deck. However, while stable for most drilling and production operations, the semi-submersible platforms still responds to the environment to such an extent that surface wellheads are unattractive due to the complexity and cost of the riser tensioner, and other clearance systems required to permit relative motion between the platform and foundation at the sea floor. Instead, relatively complex and costly subsea production equipment is typically used in conjunction with the semisubmersible platform to produce hydrocarbons from semisubmersible floating production platforms.

Another class of compliant floating structure is moored by a vertical tension leg mooring system. This tension leg mooring provides compliant restraint of first and second order horizontal motions. In addition, such a structure stiffly restrains vertical first and second order responses of heave and pitch/roll. The tension leg platform (TLP) is a platform for drilling and production operations that is moored to the sea floor using stiff vertical tethers (also commonly called tendons). The TLP hull and deck which together comprise the platform are similar in configuration construction and hydrodynamic properties to the semi-submersible floating platform. The hull provides excess buoyancy to support the deck and to tension the tethers and production risers. The deck supports drilling and production facilities.

Mooring the platform using stiff, vertical tethers which are tensioned by the excess buoyancy of the hull, virtually eliminates the heave, roll and pitch motions associated with the semisubmersible. The tension legs are maintained in tension at all times by insuring that the buoyancy of the TLP exceeds operating weight under all environmental conditions. Put another way, the tendons must be under sufficient tension that no tendon will go slack in a design storm, usually a 100-year storm.

Thus, a tension leg platform provides a very stable floating offshore structure for supporting equipment and carrying out functions related to oil production. As a result, a heave-restrained platform is provided which permits surface wellheads to be used with all of their operational benefits. Heave restraining the entire platform, however, including the drilling rig, crews quarters, and ancillary production equipment requires a substantial amount of additional structural mass, thus additional buoyancy and tether steel, thereby increasing the overall cost and size of the TLP to a point which is great compared to the operational benefit gained.

For installations in very deep water, a tension leg platform must become larger and more complex in order to support a plurality of extremely long and increasingly heavy risers and tension legs and/or the tension legs themselves must incorporate some type of buoyancy to reduce their weight relative to the floating platform. Such considerations add significantly to the cost of a deep water TLP installation. In the conventional TLP, the risers are connected to the TLP by riser tensioners which are expensive and because they contain various moving parts are subject to mechanical wear and breakdown. Additionally, the risers constitute "parasitic" weight on the conventional TLP. Particularly, in deep water, this increase in weight leads to larger and larger minimum hull displacements. As in aircraft and motor vehicle design, there is a multiplying effect. That is, each unit of additional payload weight (or tension) requires additional structural weight to support it which in turn requires still more weight or mass of the structure.

Conventional TLP structures must also have the ability to withstand the effects of extreme environmental events (a design storm) such as a hurricane, while in place. This is considered to be of first importance because this requirement controls the size of the flotation structure and the initial tension forces in the tendons and risers. With conventional TLP structures, to assure proper top end support so as to limit riser responses in severe weather conditions, riser top tension must be increased at a greater rate than the rate by which the water depth is increased. Therefore, risers and riser tensions tend to place an ever increasing load on the floating TLP structures as they are placed in deeper waters.

Most floating production systems which are subject to environmental extremes have a degree of disconnect between the well system and the floating support vessel. This usually means a separation between subsea wells and the surface vessel. Catenary anchored semisubmersibles and modified tankers are the usual types of surface unit. Since the advent of tension leg platforms, there have been numerous attempts made to couple the second hand semisubmersible platform with top side wells (above the water line) without any applied success. None in the art have been successful in achieving a workable application. Most indicate complex mechanical attachments or very impractical and costly designs.

Background art references having particular relevance to the invention at hand include the following:

U.S. Pat. No. 4,913,238, which is entitled "Floating/-Tensioned Production System With Caisson" (Danazcko et al) relates to generally combining a tension leg platform with a semi-submersible platform. The semi-submersible platform is provided with a working deck supported above the water's surface so that an air gap exists between the working deck and the water's surface. The tension leg platform provides a heave-restrained production deck for near surface wellhead equipment. However, the production deck of the TLP is supported above the drill site but beneath the water surface by buoyancy members. A caisson which surrounds the production deck is used to provide a substantially dry working area. In this embodiment, the use of retractable caisson connected to the production deck of the TLP or the use of the caisson suspended from the bottom of the semi-submersible's platforms working deck, makes this a complicated and costly technology to use for deep water hydrocarbon production. This invention also discloses a motion compensation means for the relative movement between the TLP and a semi-submersible that is complex and not meant to be conveniently disconnected.

U.S. Pat. No. 4,702,321 entitled "Drilling Production And Oil Storage Caisson For Deep Water" (Horton) discloses a spar buoy vessel having risers with buoyant means held in a top and bottom frame such that the floater is free to move vertically with respect to the risers. The spar buoy configuration is known to be one means of imparting wave transparency to a floater. However, the floater is not a TLP and is free to heave. Furthermore, removing the weight of the risers from the floater does not lead to the large savings of reducing parasitic weight which is effected according to the invention at hand. In other words, only the buoyancy needed to hold up the risers is reduced, not the multiplying effect which results from reducing parasitic weight on a TLP.

U.S. Pat. No. 4,966,495 entitled "Semisubmersible Vessel With Captured Constant Tension Buoy" (Goldman) supplemented by U.S. Pat. No. 4,606,673 entitled "Spar Buoy Construction Having Production and Oil Storage Facilities and Method of Operatien" (Daniell) disclose a constant tension buoy for wellheads in a "moonpool" of a semisubmersible shaped floater moored in a lateral fashion. All of the risers are rigidly connected and integral with the constant tension buoy which functions like a mini TLP in the passageway of the floater involved, a semisubmersible shaped floater in the case of U.S. Pat. No. 4,966,495 and a spar buoy shaped floater in the case of U.S. Pat. No. 4,606,673. The spar buoy configuration as well as the semisubmersible configuration are known to have wave transparent attributes. In neither of these references is there any suggestion of tethering the floater down to constitute a TLP. U.S. Pat. No. 4,966,495 is also a massive and complex structure not intended to be moveable.

These references are also related to the COBRAS concept disclosed in *Ocean Industry*, March, 1976, pages 67–69. In the COBRAS concept, the risers are connected to a riser buoyancy chamber below the platform which functions as a "false sea bed" enabling access to the risers from a floater which is moored overhead. The concept of U.S. Pat. No. 4,966,495 is also disclosed in Ocean Industry, April/May, 1991, pages 75–77 in that a wellhead deck is fixed to risers, both it and the risers having buoyancy functioning similar to a TLP inside the "moonpool" of a floater which is moored in place. The floater, however, is not suggested to be tethered down to constitute a TLP.

The following references appear exemplary of the state of the art: U.S. Pat. Nos. 5,150,987; 5,135,327; 5,147,148; *Petroleum EnGineer International,* January 1993, Pages 48–51; U.S. Pat. No. 5,190,411; UK Patent Application No. 2,250,767 A.

There continues to be a compelling need for improved platforms and drilling/production systems, particularly those which are less costly and safer for production of hydrocarbons from beneath very deep water. Unless this need is satisfied, only very rich reservoirs will support development at such relatively great depths. Therefore, it is appropriate to examine all aspects of deep water drilling and production systems in order to identify those features which are most sensitive to increasing water depths.

SUMMARY OF THE INVENTION

The present invention provides a deep water interruptive mobile production system of relatively low complexity which combines the advantages of a laterally (catenary) moored semisubmersible with some of the advantages of a tension leg wellhead platform at a greatly reduced cost and improved safety.

In the interruptive mobile production system (IMP) an absolute minimum structure, a small tension leg wellhead platform, is left on site in advance of an extreme environmental event such as a hurricane (or design storm). The interruptive mobile production system combines "topside" well technology with a low budget (second-hand) semisubmersible production support vessel. The IMP significantly lowers the cost of deep water development. The IMP system uses a deep water production unit with direct vertical access to each topside well for easy and low cost well workover and general well maintenance. The IMP system is designed to function continuously through normal weather but, in extreme weather conditions the production tender suspends operations and quickly and conveniently demobilizes away from the hurricane path.

The basic concept incorporates two separate floating structures, the first being a small, low free-board, wellhead platform supporting only risers and wellheads and moored to the sea bed with a tension leg mooring system, second being a converted semisubmersible mobile structure.

In accordance with the invention, an interruptive mobile production system comprises a floating semisubmersible structure with equipment and facilities for hydrocarbon production and a small tension leg wellhead platform connected to the semisubmersible structure. The small wellhead platform has an upper deck positioned above the surface of the water with wellhead equipment thereon and risers connecting subsea wells to the upper deck. The wellhead platform supports the risers and is held generally above the drill site with a tension leg mooring system which moors the platform to the sea floor. The small wellhead platform also has corner columns connecting the upper deck to a lower pontoon section.

In order to control top angles, minimize the required size of the well bay area and limit the range of top tension variations due to wave action and platform offsets, a preferred arrangement will have lateral bending restraints of the risers and tendons at about the same horizontal level as the lower pontoon section. The effects of centralizing the risers at this level show that the consequences for riser bending stresses can be accommodated by various plausible configurations. This eliminates the multiplying effect of building larger and larger tension leg platforms to support riser weight by in effect having lateral bending restraints on a relatively small tension leg wellhead platform which eliminates the needs for riser tensioners and extremely large diameter tendons. In a preferred embodiment, the lower hull of the semisubmersible structure is modified so as to allow the wellhead platform to be brought underneath for direct vertical access to the wellhead platform by the semisubmersible structure.

The interruptive mobile production system also comprises a means for conveniently disconnecting the semisubmersible structure from its mooring and from the wellhead platform for demobilizing to another location. The wellhead platform remains connected to the floor of the body of water by means of the tendons and risers. For example, before a hurricane event the semisubmersible disconnects from the wellhead platform and demobilizes to a safe location. During a hurricane the tension leg mooring system keeps the small wellhead platform on station. The ability of the IMP wellhead platform and its sub-systems to withstand the effects of the extreme (hurricane and/or loop current) environmental event while in place is very important because this requirement controls the size of the flotation structure and the initial tension forces in the tendons and risers.

It must be pointed out that the foregoing changes in TLP design basics could not be made for a large TLP. The smaller tension leg wellhead platform of the IMP system has virtually no wind load which is the major factor in the TLP offset. The basic wellhead platform unit has little or no lateral resistance to motion in normal operating sea states. The lower angular offset can be accommodated by bending the risers at the pontoon level. Therefore no riser tensioners and no riser watch circle are needed and a much more compact pontoon arrangement can be accommodated. Thus the present invention as exemplified by the foregoing modes, provides a deep water drilling and production facility of considerably reduced complexity and cost with improved safety.

BRIEF DESCRIPTION OF THE DRAWINGS

The objects of the invention will be apparent from the following description taken in conjunction with the drawings which form a part of this specification. A brief description of the drawings follows.

DETAILED DESCRIPTION OF THE INVENTION

Figure 1:
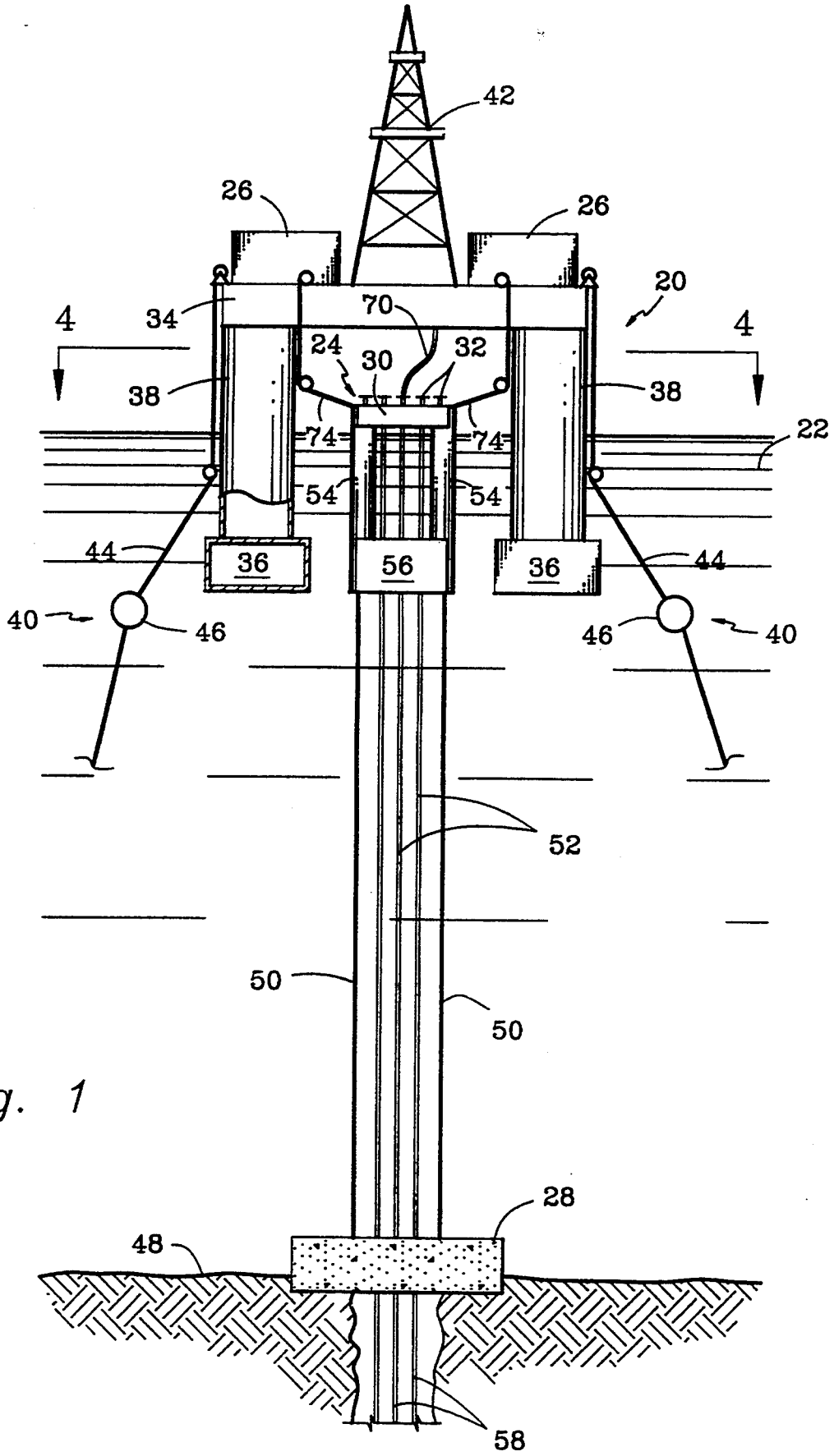
FIG. 1 is an elevational view, with part in cross section, of the offshore platform system for hydrocarbon production illustrating the semisubmersible production structure and the small tension leg wellhead platform.
Figure 2:
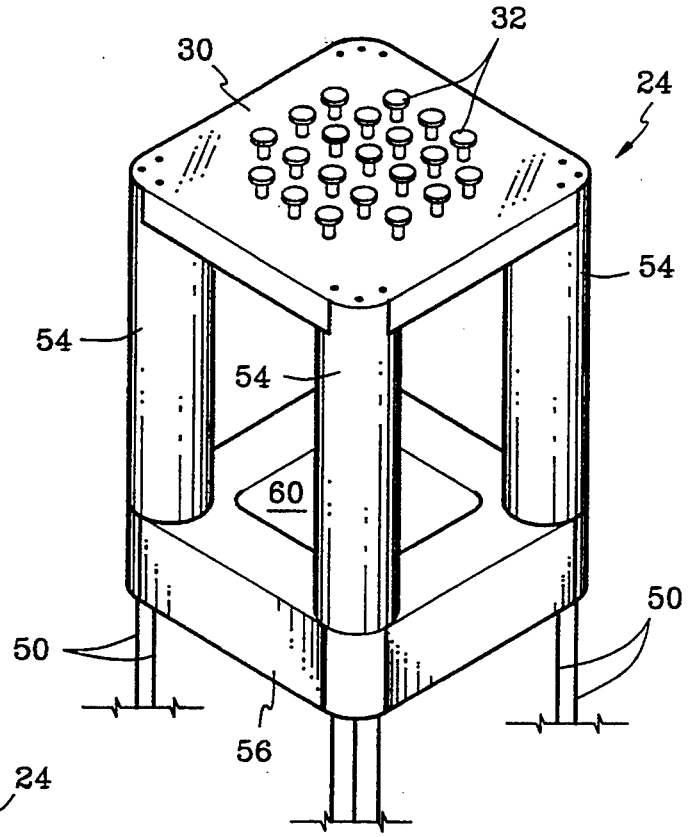
FIG. 2 is a perspective view of the small offshore tension leg wellhead platform.

FIGS. 1 and 2 generally illustrate the offshore interruptive mobile production system of the present invention. As shown in FIG. 1, a floating semisubmersible production structure 20, floating on a body of water 22, is connected to a small tension leg wellhead platform (TLWP) 24. The semisubmersible production unit 20 contains facilities and equipment 26 for the production of hydrocarbons. In the illustrated embodiment, the semisubmersible structure 20 is situated generally above the small TLWP 24 so that the semisubmersible structure 20 has direct vertical access to the TLWP 24 by means of a ramp, stair, elevator or the like (not shown). As shown in FIG. 1, the TLWP 24 is generally centered over the seabed template 28 and well site. The TLWP 24 is positioned so that its upper deck 30, with wellhead equipment 32 thereon, is above the water surface 22 but below the semisubmersible production structure's 20 working deck 34 and generally between buoyancy chambers 36 and vertical columns 38 of semisubmersible structure's 20 floatation means. The components of the semisubmersible structure 20 and the small tension leg wellhead platform 24 are more fully described in the following paragraphs.

The interruptive mobile production system incorporates two separate floating structures, the first being a small, low, free-board production riser support unit (the TLWP 24), the second being a converted semisubmersible mobile unit 20. In the interruptive mobile production system an absolute minimum structure is left on site in advance of an extreme environmental event such as a hurricane (or design storm). The IMP system tender (the semisubmersible structure 20) sits over the wellhead platform 24 providing direct vertical access to the wellbore and seabed template 28. The semisubmersible production and well maintenance unit 20 may be a second or third generation semisubmersible vessel with modified bracing and pipe rack located process modules (not shown).

The embodiment of the floating semisubmersible structure 20 illustrated in FIG. 1 includes a working deck 34 supported by a flotation means 36 and held in place by a catenary mooring means 40. The equipment on working deck 34 may include a drilling rig 42 and production facilities 26. At least one buoyancy chamber 36 or pontoon is provided and supports one or more vertical columns 38 which support working deck 34. The semisubmersible structure 34 can be floated to the well site and buoyancy chambers 36 partially flooded such that vertical columns 38 will come to rest partially under the water surface 22 while maintaining working deck 34 above water surface 22.

Semisubmersible structure of 34 is held in place by a restorative lateral mooring system 40 which can be an inverted catenary mooring means (or spring buoy)(as shown), or catenary lines, or clump weight lines, the restorative lateral mooring system having the ability to bring the semisubmersible structure back on vertical station with increasing horizontal restorative force as it deviates to a greater extent from its vertical station. In a preferred embodiment, catenary mooring is used. Specifically, catenary mooring uses several mooring lines 44 and buoys 46 (approximately 8 in number) attached in different locations around semisubmersible structure 20 and positioned in different directions along the sea floor 48. While semisubmersible structures are well known in the field of offshore operations, one unique feature in the design of the floating semisubmersible structure 20 of the interruptive mobile production system is that the area below working deck 34 is modified and substantially unobstructed to allow the small TLWP 24 to be situated underneath the working deck 34 which provides direct vertical access to the small TLWP 24 and the well site 28.

As illustrated in FIGS. 1 and 2, the small tension leg wellhead platform 24 has an upper deck 30 that is positioned above the surface of the water 22 and contains wellhead equipment 32. A sea bed template (or the well site) 28 is situated on the sea floor 48 above the wellbore 58 and in proximity of the offshore reservoir. Sea bed template 28 is constructed and anchored to the sea floor 48 in such a manner as to provide sufficient anchorage for the TLWP 24 to withstand forces arising from the TLWP's 24 response to wave and tide movements. A plurality of tendons 50 vertically connect the upper deck 30 of the TLWP 24 to the sea bed template 28. The upper deck 30 is positioned above the surface of the water 22 and has a plurality of corner columns 54 connecting the upper deck 30 to a buoyant lower pontoon means 56 which is positioned below the surface of the water 22. Extending from the TLP 24 upper deck 30 to the sea bed template 28 and connecting a subsea well to said upper deck 30 is at least one riser 52.

The interruptive mobile production system incorporates an "above the water line" disconnect which permits the semi-submersible support vessel 20 to leave the site in the event of a hurricane or similar extreme event. The IMP system is designed to function continuously through normal weather but, in extreme weather conditions the production tender (or semisubmersible 20) suspends operations and demobilizes away from the hurricane path.

Figure 4:
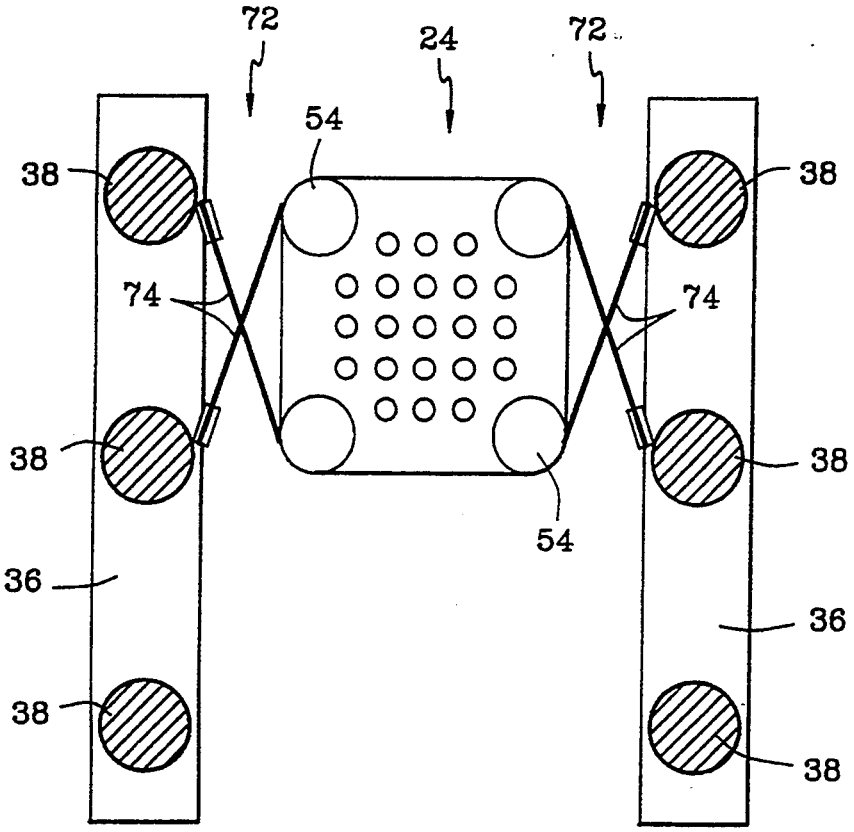
FIG. 4 is a plan view along line 4—4 of FIG. 1, of a means for connecting the semisubmersible structure to the tension leg wellhead platform using a cross springs mooring system.

As illustrated in FIGS. 1 and 4, the semisubmersible structure 20 is connected to the small TLWP 24 in such a way as to be conveniently and quickly disconnected from the wellhead platform 24 and from mooring means 40. The semisubmersible structure 20 can be moved to another, safer location in the event of extreme weather and the wellhead platform 24 remains connected to the floor 48 of the body of water 22 by means of the risers 52 and tendons 50. The risers 52 and tendons 50 are under sufficient tension so that no riser 52 or tendon 50 will go slack in a design storm. The catenary mooring means 40 which moors the semisubmersible structure 20 to the sea floor 48, has mooring lines 44 which are conveniently disconnected at the mooring buoys 46 and secured to the working deck 34 of the semisubmersible structure 20. FIG. 4 illustrates the means for connecting the semisubmersible structure 20 to the wellhead platform 24. The preferred embodiment is a cross springs mooring system 72. Cables are used in a cross springs mooring system 72 wherein the semisubmersible structure 20 is conveniently and quickly disconnected from the wellhead platform 24 by releasing the cable from the wellhead platform 24 and securing the cable 74 onto the semisubmersible structure 20. Both the catenary mooring and cross springs mooring systems may use standard quick release couplings or the like (not shown), which are standard for mooring systems, pipelines and umbilicals.

The TLWP 24 of the IMP system has little or no lateral resistance to motion in normal operating sea states. The semi-submersible deck mounted mooring winches are quite capable of supporting the small TLWP 24 in an internal mooring system to hold the TLWP 24 in any desired position within the semi-submersible pontoons.

Figure 5:
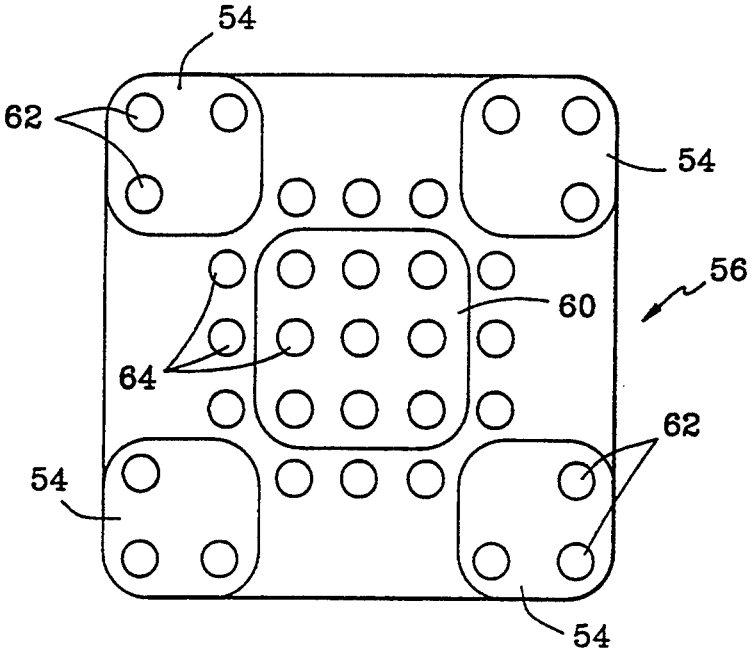
FIG. 5 is a plan view of an embodiment of the lower pontoon means of the tension leg wellhead platform.

In one embodiment of the invention, as shown in FIG. 5, the risers 52 penetrate through holes in the lower pontoon means 56. In another embodiment of the invention, the lower pontoon means 56 includes a moonpool and a template 60 in the center of said pontoon means 56. The moonpool is also illustrated in FIG. 2. The risers 52 would then penetrate through holes in the moonpool template 60 shown in FIG. 5. Also in a preferred embodiment, the corner columns 54 are hollow and contain hollow tubes 62 through which the tendons 50 pass. In FIG. 5 is illustrated a planned view of the pontoon means 56 showing corner columns 54 and hollow tubes 62 through which the tendons 50 will pass.

Figure 6A:
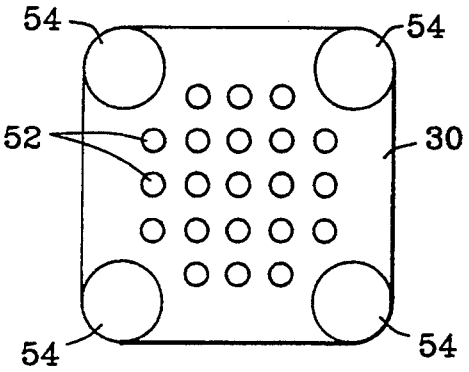
FIG. 6A is a plan view of the upper deck of the small tension leg wellhead platform in an embodiment having twenty risers.
Figure 6B:
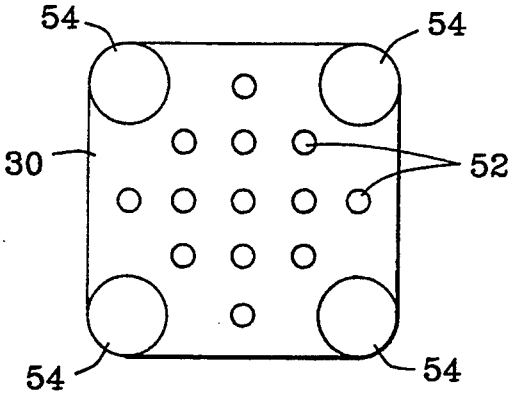
FIG. 6B is a plan view of the upper deck of the small tension leg wellhead platform in an embodiment having twelve risers.

FIGS. 6A and 6B are plan views illustrating different embodiments of the small tension leg wellhead platform's 24 upper deck 30 are alternately showing embodiments of a TLWP whose upper deck is approximately 70 feet square with spacing for approximately 21 wells (FIG. 6A) or 33 wells (not shown) and alternately a TLWP whose upper deck is approximately 60 feet square with spacing for 13 wells (FIG. 6B). The wellhead platform is capable of carrying up to 33 (thirty-three), $9\frac{5}{8}$ (nine and five-eighths) inch risers.

Figure 3:
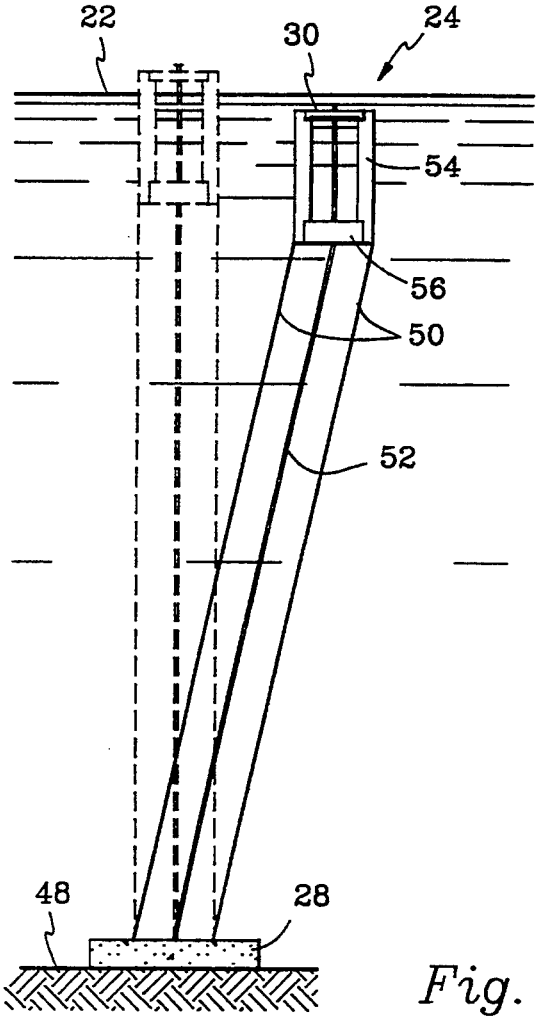
FIG. 3 is an illustration of the lateral movement of the small tension leg wellhead platform wherein a parallelogram configuration is formed by the tendons and risers.

The tension leg wellhead platform 24 also includes a means for laterally restraining the tendons 50 and the risers 52 at or near the horizontal level of the lower pontoon means 56. In order to control top angles, minimize the required size of the well bay area and limit the range of top tension variations due to wave action and platform offsets, a preferred arrangement of the TLWP 24 will have lateral bending restraints of the risers at about the same horizontal level as the tendon lateral restraints. The effects of centralizing the risers at this level show that the consequences for riser bending stresses can be accommodated by various plausible configurations. Options would include elastic lateral support at this level or some type of control devices. As illustrated in FIG. 3, the tendons 50 and risers 52 form a parallelogram configuration so that the lateral distance between the tendons 50 and the risers 52 does not substantially vary from the upper deck 30 of the TLWP 24 to the floor 48 of the body of water 22, nor does the length of the tendons 50 and risers 52 substantially vary from the upper deck 30 to the floor 48 of the body of water 22, as the TLWP 24 moves laterally and sets down in the water in a design storm.

Figure 7:
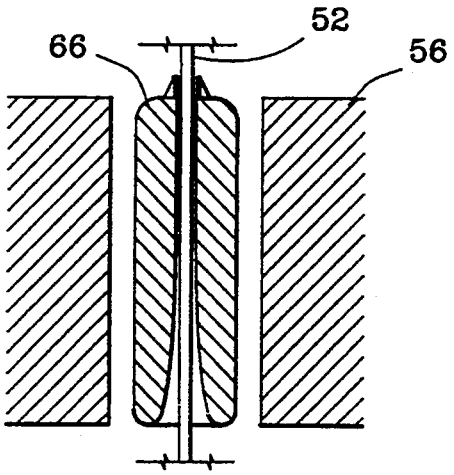
FIG. 7 is a cross sectional view of a laterally restraining means attached to a riser (or tendon) near the horizontal level of the pontoon means.
Figure 8:
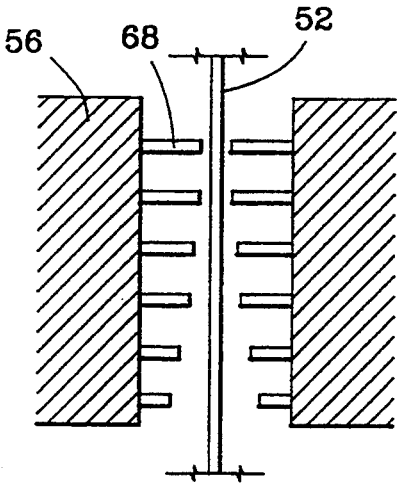
FIG. 8 is a cross sectional view of a laterally restraining means for a riser (or tendon) affixed to the hole in the pontoon means (or the hollow tube for the tendon).

Alternative embodiments for a means for laterally restraining the tendons 50 and risers 52 at or near the horizontal level of the lower pontoon means 56 are illustrated in FIGS. 7 and 8. In one embodiment, as illustrated in FIG. 7, an elastic element 66 is affixed to the riser 52 and/or the tendon 50 and is resistant to bending wherein the riser 52 and/or tendon 50 is allowed to bend only to a small degree (approximately 5 degrees or less) as the wellhead platform 24 moves laterally. Another embodiment illustrated in FIG. 8 wherein the means for laterally restraining the riser 52 and/or tendon 50 includes a series of resilient rings 68 affixed to the holes 64 of the pontoon means 56 and/or the hollow tubes 62 in the columns 54, with the resilient ring 68 tapered towards the bottom end of the pontoon means 56 wherein the risers 52 and/or tendons 50 are allowed to bend only to a small degree (approximately 5 degrees or less) as the wellhead platform 24 moves laterally.

Riser tensioners are not required to be used in the interruptive mobile production system of the present invention. In a preferred embodiment, flexural, structural elements such as wedge slips (not shown) can be used to connect the tendons 50 and risers 52 to the upper deck 30 of the tension leg wellhead platform 24.

The illustrated changes in TLP design basics could not be made for a large TLP. The smaller TLWP 24 unit has virtually no wind load (hurricane) which is a major factor in the TLP offset. In similar water depths, the TLWP 24 offsets only about 60 feet in a hurricane whereas the larger TLPs will offset more than 180 feet. This lower angular offset can be accommodated by bending the risers 52 at the pontoon level 56. Therefore no riser tensioners and no riser watch circle are needed in a much more compact pontoon arrangement can be accommodated. There are also no interference problems with the semi-submersible pontoons.

A method is also described for installing the interruptive mobile production system of the present invention for hydrocarbon production from an offshore reservoir including setting a sea bed template 28 on the floor 48 of the body of water 22 in proximity of the offshore reservoir as illustrated in FIG. 1. The sea bed template 28 is anchored to the floor 48 of the body of water 22 and at least one well 58 is drilled into the offshore reservoir through the sea bed template 28 using a semisubmersible drilling unit (not shown). A plurality of tendons 50 are anchored to the sea bed template 28 and a buoyancy means (not shown) is attached to the upper end of the tendons 50 wherein the tendons 50 are held in vertical tension near the surface of the body of water 22.

The IMP system has been designed specifically so that all installation activities can be executed without resort to an expensive heavy lift crane vessel. The IMP wellhead support platform is virtually self installing other than for manual and ROV diving support. The small tension leg wellhead platform 24 floating on the surface of the body of water 22 is installed over the sea bed template 28 by connecting the upper ends of the tendons 50 to the upper deck 30 of the wellhead platform 24. The semisubmersible drilling unit is removed and the semisubmersible production unit structure 20 is installed over the small TLWP 24 wherein the semisubmersible production structure 20 has direct vertical access to the tension leg wellhead platform 24 and the well site 28. The semisubmersible production structure 20 is then connected to the wellhead platform 24 with a cross springs mooring system 72 using cables 74. The risers 52 are then installed from the semisubmersible production structure 20 through the tension leg wellhead platform 24 and extending to the sea bed template 28. The risers 52 are attached to the upper deck 30 of the wellhead platform 24. At least one flexible flowline 70 is installed from the upper deck 30, wellhead equipment 32 manifold of the TLWP 24 to the production facilities and equipment 26 on the semisubmersible structure 20's wörking deck 34 for the transfer of hydrocarbons from the offshore reservoir to the semisubmersible production unit. The flexible flowline 70 could be "sales risers" as used in the art, one for oil and one for gas, or the flowlines could be one or more control umbilicals for wellhead controls.

Thus the present invention as exemplified by the foregoing modes, provides a deep water drilling and production facility of considerably reduced complexity and cost with improved safety. Those skilled in the art are familiar with other uses of the individual components of the invention described in the summary, with many manifestations of such components being known to those skilled in the art or which will readily suggest themselves to the skilled practitioner of the art. The modes described here and above are to exemplify the invention for the understanding of those skilled in the art. They are not to be considered as limiting of the invention as set forth in the claims and equivalents hereof.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. An offshore interruptive mobile production system for hydrocarbon production from an offshore reservoir and including provisions for conveniently mobilizing portions of the system for movement to an another location, the system comprising in combination:

a floating semisubmersible structure floating on a surface of a body of water and containing facilities and equipment for the production of hydrocarbons;

a small tension leg wellhead platform connected to the semisubmersible structure and having an upper deck positioned above the surface of the water and having wellhead equipment thereon in fluid connection and communication with the facilities and equipment for the production of hydrocarbons, a multiplicity of hollow corner columns, a lower pontoon section positioned below the surface of the water and at or near the bottom of the columns, the water displacement volumes of the columns and pontoon section positioned and sized such as to impart wave transparency attributes to the platform,at least one riser connecting a subsea well in fluid communication to the upper deck of the platform, the riser having lateral bending restraints at or near the same horizontal level as the lower pontoon section, and tendons connecting the upper deck of the platform to the floor of the body of water, the tendons having lateral restraints at or near the same horizontal level as the lower pontoon section;

mooring means for the floating semisubmersible structure; and means for conveniently disconnecting the semisubmersible structure from the mooring lines and the wellhead platform wherein fluid communication of the subsea well is shut off upon disconnect, wherein the semisubmersible can be moved to another location, and wherein the wellhead platform remains connected to the floor of the body of water by means of the riser and tendons, the riser and tendons being under sufficient tension so that no riser or tendon will go slack in a design storm.

2. The offshore interruptive mobile production system of claim 1 wherein the riser and tendons are maintained in vertical tension solely by the buoyancy of the tension leg wellhead platform.

3. The offshore interruptive mobile production system of claim 1 wherein the riser and tendons are arranged in a configuration so that the lateral distance between the riser and tendons does not substantially vary from the platform upper deck to the floor of the body of water.

4. The offshore interruptive mobile production system of claim 1 further including at least one flexible flowline connecting the semisubmersible structure to the wellhead platform for the transfer of hydrocarbons.

5. The offshore interruptive mobile production system of claim 1 further including a means for connecting the semisubmersible structure to the tension leg wellhead platform wherein the semisubmersible has direct vertical access to the wellhead platform.

6. The offshore interruptive mobile production system of claim 5 wherein the means for connecting the semisubmersible to the wellhead platform includes a cable, cross springs mooring system.

7. The offshore interruptive mobile production system of claim 1 wherein the means for conveniently disconnecting said semisubmersible from the wellhead platform includes a cable cross springs mooring system and is secured onto the semisubmersible.

8. The offshore interruptive mobile production system of claim 1 wherein the means for conveniently disconnecting the semisubmersible from the mooring means includes a restorative lateral mooring system.

9. An offshore wellhead platform floating on a surface of a body of water for hydrocarbon production from an offshore reservoir comprising:

an upper deck positioned above the surface of the water and having wellhead equipment;

a multiplicity of corner columns;

buoyant lower pontoon means positioned below the surface of the water and at or near the bottoms of the columns, the water displacement volumes of the columns and pontoon section being sized and positioned such as to impart wave transparency attributes to the platform;

a multiplicity of tendons vertically connecting the upper deck to the floor of the body of water;

at least one riser connecting a subsea well to the upper deck; and means for laterally restraining the tendons and the riser at or near the horizontal level of the lower pontoon means, wherein the tendons and riser form a configuration so that the lateral distance between the tendons and risers does not substantially vary from the upper deck to the floor of the body of water, nor does the length of the tendons and risers substantially vary from the upper deck to the floor of the body of water, as the wellhead platform moves laterally and sets down in the water in a design storm.

10. The offshore platform of claim 9 wherein the riser penetrates through a hole in the lower pontoon means.

11. The offshore platform of claim 10 wherein the means for laterally restraining the riser includes an elastic element affixed to the riser and resistant to bending wherein the riser is allowed to bend at the at the locus of lateral restraint only to a small degree as the wellhead platform moves laterally.

12. The offshore platform of claim 10 wherein the means for laterally restraining the riser includes a series of resilient rings affixed to the hole in the pontoon means and arranged to provide an opening tapered progressively larger towards the bottom end of the pontoon means, wherein the riser is allowed to bend at the locus of lateral restraint only to a small degree as the wellhead platform moves laterally.

13. The offshore platform of claim 9 wherein the lower pontoon means includes a moonpool and a template in the center of the pontoon means.

14. The offshore platform of claim 13 wherein the riser penetrates through a hole in the moonpool template.

15. The offshore platform of claim 14 wherein the means for laterally restraining the riser includes an elastic element affixed to the riser and resistant to bending wherein the riser is allowed to bend at the locus of lateral restraint only to a small degree as the wellhead platform moves laterally.

16. The offshore platform of claim 14 wherein the means for laterally restraining the riser includes a series of tapered resilient rings affixed to the hole in the moonpool template to provide an opening which is progressively larger towards the bottom end of the pontoon means, wherein the riser is allowed to bend at the locus of lateral restraint only to a small degree as the wellhead platform moves laterally.

17. The offshore platform of claim 9 wherein the corner columns contain tubes through which the tendons pass.

18. The offshore platform of claim 17 wherein the means for laterally restraining the tendons includes and elastic element affixed to each tendon and resistant to bending wherein the tendons are allowed to bend at the locus of restraint only to a small degree as the wellhead platform moves laterally.

19. The offshore platform of claim 17 wherein the means for laterally restraining the tendons includes a series of tapered resilient rings affixed within the bottom of the tubes and progressively smaller towards the bottom end of the tubes, wherein each tendon is allowed to bend at the locus of restraint only to a small degree as the wellhead platform moves laterally.

20. The offshore platform of claim 9 wherein the upper deck includes a surface area no greater than 3,600 square feet and at least 13 riser positions.

21. The offshore platform of claim 9 wherein the upper deck includes a surface area no greater than 4,900 square feet and at least 21 riser positions.

22. The offshore platform of claim 9 wherein the upper deck includes a surface area no greater than 4,900 square feet and at least 32 riser positions.

23. The offshore platform of claim 9 wherein the wellhead platform is connected to a floating semisubmersible structure having facilities and equipment for the production of hydrocarbons thereon.

24. A method for installing an offshore interruptive mobile production system for hydrocarbon production from an offshore reservoir comprising:

setting a seabed template on the floor of a body of water in proximity of the offshore reservoir;

anchoring the seabed template to the floor of the body of water;

drilling at least one well into the offshore reservoir through the seabed template using a semisubmersible drilling unit;

anchoring a multiplicity of tendons to the template and attaching a buoyancy means to the upper end of the tendons wherein the tendons are held in vertical tension near the surface of the waters;

installing a small tension leg wellhead platform having an upper deck and a lower pontoon section and floating on the surface of the water over the template, by connecting the upper ends of the tendons to an upper deck of the wellhead platform;

removing the semisubmersible drilling unit;

installing a semisubmersible production unit over the small tension leg wellhead platform wherein the semisubmersible production unit has been modified so that the semisubmersible production unit has direct vertical access to the wellhead platform;

connecting the semisubmersible production unit to the tension leg wellhead platform;

installing at least one riser from the semisubmersible production unit through the tension leg wellhead platform to the seabed template and connecting the riser to the upper deck of the wellhead platform;

restraining the riser and tendons on the tension leg wellhead platform at the same horizontal level as the lower pontoon section; and installing at least one flowline from the upper deck of the wellhead platform to the semisubmersible production unit for the transfer of hydrocarbons from the offshore reservoir to the production unit.

25. A method for installing an offshore wellhead platform for hydrocarbon production from an offshore reservoir comprising:

drilling at least one well into the offshore reservoir;

anchoring a multiplicity of tendons to the floor of a body of water in proximity of the offshore reservoir and attaching a buoyancy means to the upper end of the tendons wherein the tendons are held in vertical tension near the surface of the body of water;

installing a small tension leg wellhead platform having an upper deck and a lower pontoon section and floating on the surface of the body of water, by connecting the upper ends of the tendons to the upper deck of the wellhead platform;

installing at least one riser through the tension leg wellhead platform to the well and connecting the riser to the upper deck of the wellhead platform; and restraining the riser and tendons at the same horizontal level as the lower pontoon section.

* * * * *